US010895356B2

(12) United States Patent
Zeng et al.

(10) Patent No.: US 10,895,356 B2
(45) Date of Patent: Jan. 19, 2021

(54) DOWNLIGHT APPARATUS

(71) Applicant: XIAMEN ECO LIGHTING CO. LTD., Xiamen (CN)

(72) Inventors: Maojin Zeng, Xiamen (CN); Qiqing Yu, Xiamen (CN)

(73) Assignee: XIAMEN ECO LIGHTING CO. LTD., Xiamen (CN)

( * ) Notice: Subject to any disclaimer, the term of this patent is extended or adjusted under 35 U.S.C. 154(b) by 0 days.

(21) Appl. No.: 16/209,880

(22) Filed: Dec. 4, 2018

(65) Prior Publication Data

US 2019/0170309 A1 Jun. 6, 2019

(30) Foreign Application Priority Data

Dec. 6, 2017 (CN) ..... 2017 2 1679717 U

(51) Int. Cl.

| | |
|---|---|
| ***F21S 8/00*** | (2006.01) |
| ***F21S 8/02*** | (2006.01) |
| ***F21V 21/04*** | (2006.01) |
| ***F21V 17/00*** | (2006.01) |
| ***F21V 23/00*** | (2015.01) |
| ***F21V 7/00*** | (2006.01) |
| *F21V 29/70* | (2015.01) |
| *F21Y 115/10* | (2016.01) |

(52) U.S. Cl.

CPC ..... *F21S 8/026* (2013.01); *F21V 7/00* (2013.01); *F21V 17/002* (2013.01); *F21V 21/04* (2013.01); *F21V 23/006* (2013.01); *F21V 29/70* (2015.01); *F21Y 2115/10* (2016.08)

(58) Field of Classification Search

CPC ... F21S 8/026; F21S 8/02; F21S 8/024; F21V 7/00; F21V 7/0058; F21V 7/0066; F21V 7/041; F21V 7/043; F21V 17/002; F21V 17/105; F21V 17/108; F21V 17/12; F21V 21/04; F21V 23/006; F21V 23/003

See application file for complete search history.

(56) References Cited

U.S. PATENT DOCUMENTS

| | | | | |
|---|---|---|---|---|
| 5,758,958 | A * | 6/1998 | Chen | B60Q 1/20 362/307 |
| 9,599,315 | B1 * | 3/2017 | Harpenau | F21V 21/04 |
| 2001/0040809 | A1 * | 11/2001 | Sools | F21S 8/026 362/343 |
| 2004/0027832 | A1 * | 2/2004 | Hyder | F21S 8/02 362/365 |
| 2007/0133218 | A1 * | 6/2007 | Yang | B60Q 1/302 362/459 |

(Continued)

*Primary Examiner* — Y M. Quach Lee

(74) *Attorney, Agent, or Firm* — Chun-Ming Shih; Lanway IPR Services

(57) ABSTRACT

A downlight apparatus has a tube body, a driver plate, a light source plate, a detachable attaching structure and a set of replaceable reflective cups. The tube body has an opening and a terminal portion opposite to the opening. The driver plate is disposed on an exterior surface of the terminal portion of the tube body. The light source plate is disposed on an interior surface of the terminal portion of the tube body. The detachable attaching structure is disposed in the opening of the tube body. One of the replaceable reflective cups is selectively detachably attached to the detachable attaching structure.

11 Claims, 6 Drawing Sheets

(56) References Cited

U.S. PATENT DOCUMENTS

| | | | | |
|---|---|---|---|---|
| 2010/0142208 | A1* | 6/2010 | Kokado | F21V 7/0066 362/296.07 |
| 2011/0096548 | A1* | 4/2011 | Pichard | F21V 7/0025 362/294 |
| 2011/0222283 | A1* | 9/2011 | Lai | F21V 29/74 362/249.02 |
| 2014/0268797 | A1* | 9/2014 | Gabrius | F21V 17/002 362/294 |
| 2018/0073704 | A1* | 3/2018 | Hierzer | F21S 8/026 |
| 2018/0112857 | A1* | 4/2018 | Wronski | F21V 21/096 |

* cited by examiner

DOWNLIGHT APPARATUS

FIELD OF INVENTION

The present invention is related to a LED light apparatus and more particularly related to a LED downlight apparatus.

BACKGROUND

Different downlight apparatuses are widely used in various working and living environments. Usually, a cavity or an installation box is disposed on a ceiling. A back portion of the downlight is placed in the cavity or the installation box.

When LED (Light Emitted Diode) technologies keep developing, more and more downlight apparatuses use LED light sources. With LED technology, there are several new technology issues like heat dissipation not seen in traditional light devices. On the other hand, LED technologies also have certain benefit not available in traditional light devices.

It is therefore helpful to find out a better solution to decrease the problem of LED technology and use the benefit of LED technology.

SUMMARY OF INVENTION

According to an embodiment, a downlight apparatus includes a tube body, a driver plate, a light source plate and a detachable attaching structure.

The tube body has an opening and a terminal portion opposite to the opening. For example, the tube body has a cup shape with a bottom side as the terminal portion. The light source plate is disposed on an interior surface of the bottom side of the tube body. The driver plate is attached to an exterior surface of the bottom side of the tube body.

The driver plate is disposed on an exterior surface of the terminal portion of the tube body. The light source plate is disposed on an interior surface of the terminal portion of the tube body. The exterior surface and the interior surface are opposite to each other, the light source plate is heat conductive to the terminal portion. For example, the light source plate engages the terminal portion directly.

The driver plate is electrically connected to the light source plate via a hole of the terminal portion of the tube body. More than one holes may also be disposed for connecting the light source plate and the driver plate so that the driver plate supplies a driving current to the light source plate.

In addition, the driver plate may also have wireless communication circuit. An antenna of the wireless communication circuit is disposed at the side of the light source plate, instead of being disposed on the driver plate so as to improve wireless signal quality.

The detachable attaching structure is disposed in the opening of the tube body.

The set of replaceable reflective cups are detachably attached to the detachable attaching structure, depending on different needs. Each reflective cup may have a different have different reflective characteristic for guiding light of the light source plate to render a different luminous effect.

With such design, users or workers for installing the downlight apparatus may replace a proper reflective cup by using the detachable attaching structure.

In some embodiments, the detachable attaching structure may include a convex structure corresponding to a concave structure of the replaceable cup. Different replaceable cups have the same concave structure.

In some other embodiments, the detachable attaching structure may include a concave structure corresponding to a convex structure of the replaceable cup. Different replaceable cups have the same convex structure.

In some other embodiments, the detachable attaching structure has a first magnet component corresponding to a second magnet component of the reflective cup. One of the first magnet component and the second magnet component may include magnet units while the other component may be also a magnet unit or a metal unit.

By using such design, it would be easier for users to replace a desired reflective cup. Additional fixing structure may also be used to enhance stability of the downlight apparatus.

In some embodiments, the detachable attaching structure has a first hook structure corresponding to a second hook structure of the reflective cup. Such hook structure may include a male part and a female part. The male part and the female part may be designed as a set. The male part is disposed in one of the first hook structure and the second hook structure and the female part is disposed in the other of the first hook structure and the second hook structure.

In some other embodiments, the detachable attaching structure is a screw structure for the reflective cup to be screwed into the screw structure to attach the reflective cup to the detachable attaching structure. For example, a screw groove may be disposed on the tube body for attaching to the reflective cup.

In some embodiments, there may be a rim surrounding the opening of the tube body, a top side of the reflective cup is close to the light source plate, and a bottom side of the reflective cup is close to the rim. The rim, the reflective cup and the tube body are arranged along the same axial line.

In some embodiment, the terminal portion of the tube body is attached with a heat sink. A cover may be used for covering and protecting the driver plate.

In some embodiments, the reflective cup has a height within range of 5 mm to 80 mm. A ratio between a largest diameter to the height of the reflective cup is between 0.05 to 0.75.

In some embodiments, one of the reflective cups has an inner reflective surface disposed with micro convex structures.

In some embodiments, the micro convex structures may include multiple ring bars arranged in parallel with respect to a top opening a bottom opening of the reflective cup.

In some embodiments, the micro convex structures may include multiple convex bars extended from a top opening to a bottom opening of the reflective cup.

In some embodiments, the micro convex structures may include multiple parallel convex bars extended from a top opening to a bottom opening of the reflective cup with a tilt angle to each other.

In some embodiments, the micro convex structures may include net shape convex bars. Specifically, the convex structures are arranged crossed to each other forming a net pattern.

Please note that the convex structure may be replaced with concave structures, or made of assembled patterns.

In some embodiments, at least one reflective cup has a first reflective part and a second reflective part. The first reflective part and the second reflective part have different reflective parameters. For example, the first reflective part is close to the terminal portion of the tube body and the second part is close to the opening of the tube body.

In some embodiments, the first reflective part has micro convex structures, and the second reflective part has a smooth reflective surface.

In some embodiments, the reflective cups have different colors. Users may install reflective cups with different colors for changing the overall luminous effect.

In some embodiments, at least one reflective cup has mixed colors, i.e. multiple colors.

In some embodiments, the reflective cup may include a light guide for guiding a light forming a light guide visual effect. For example, the reflective cup is made of PMMA material for guiding light into the light guide and escaping the light at desired positions, e.g. forming a ring visual effect.

In some embodiments, the reflective cup is disposed with a lens on a light passing opening of the reflective cup. A diffusion layer may also be installed in some other reflective cups. In other words, the same downlight apparatus may be adjusted to a focus light device or a diffusion light device depending on needs.

DETAILED DESCRIPTION

Figure 1:
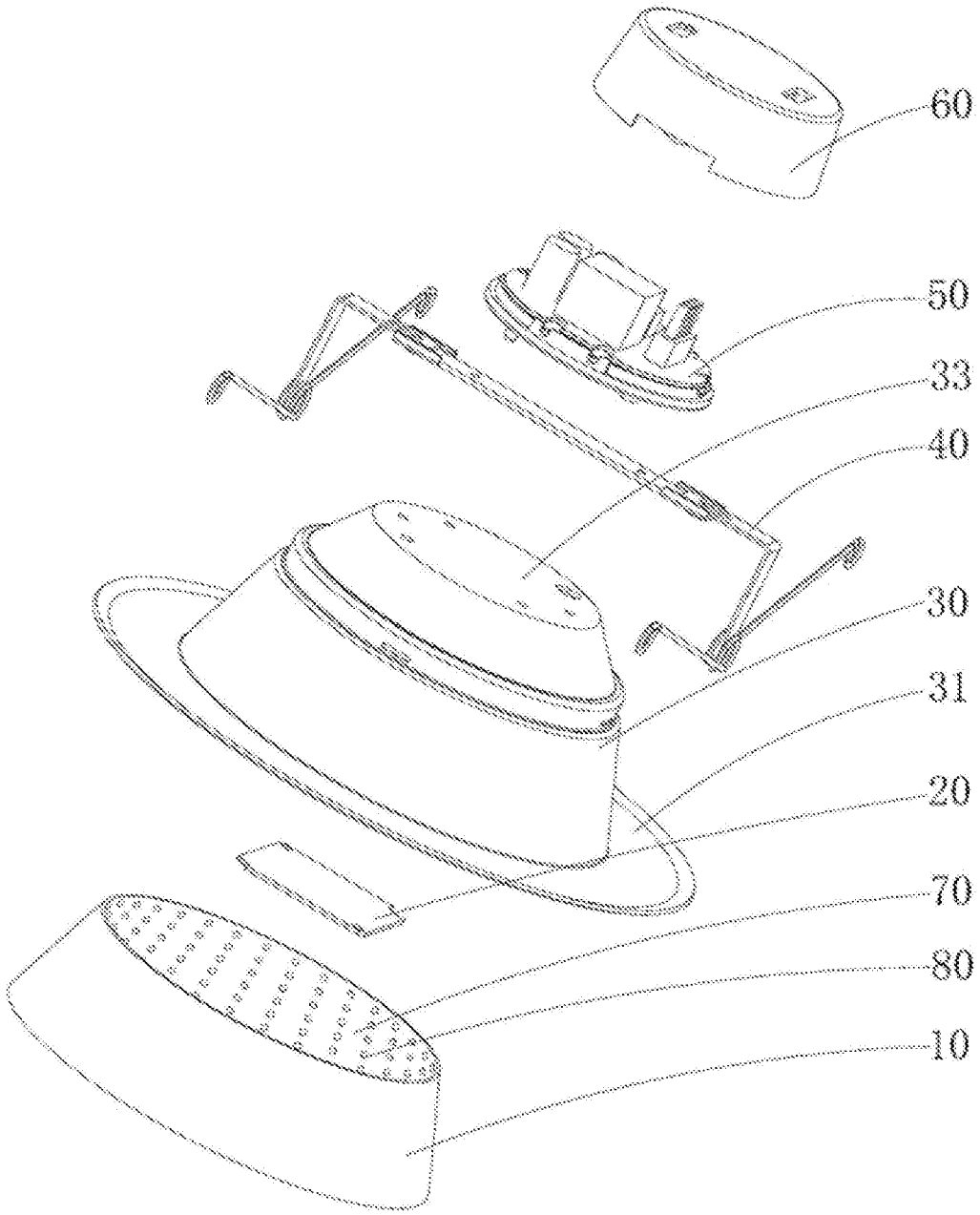
FIG. 1 illustrates an exploded diagram of a downlight apparatus embodiment.
Figure 2:
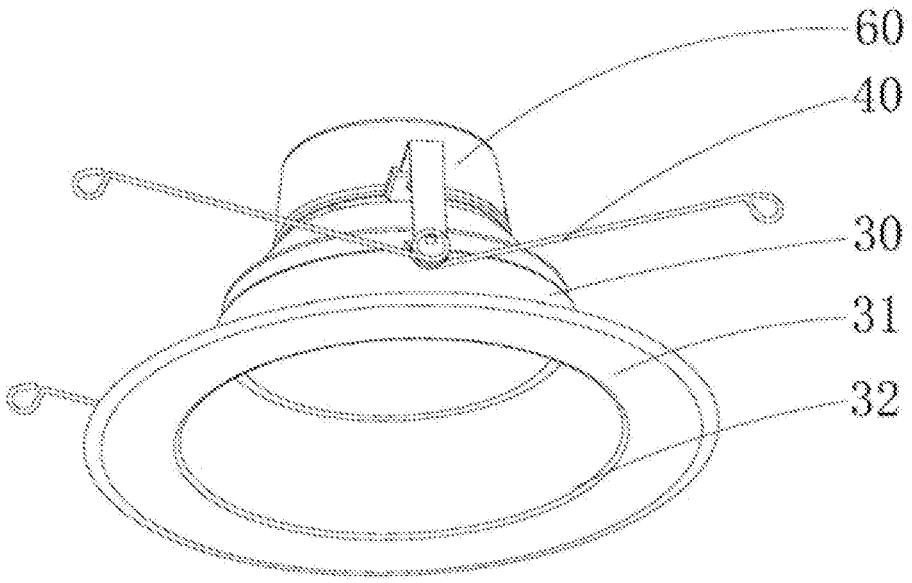
FIG. 2 illustrates a perspective view of a tube body of a downlight apparatus embodiment.

Please refer to FIG. 1 to FIG. 4, which illustrate a downlight apparatus. The downlight apparatus includes a driver plate 50, a tube body 30 and light source plate 20.

The tube body 30 has an opening 32 and a terminal portion 33. The terminal portion 33 and the opening 32 are two opposite ends of the tube body 30.

The driver plate 20 is disposed on an exterior surface of the terminal portion 33 and the light source plate 20 is disposed on an interior surface of the terminal portion 33.

The light source plate 20 and the driver plate 50 are electrically connected so that the driver plate 20 supplies a driving current to the light source plate 20 to emit light escape from the opening 32.

The tube body 30 may be made of one heat conductive material as an unibody component or multiple components assembled together. For example, metal fins may be attached to a plastic housing to form the tube body 30.

By placing the driver plate 50 outside the tube body 30 also prevents affecting the life span of the downlight apparatus.

The downlight apparatus may be connected to a set of reflective cups 10. Each reflective cup 10 has different reflective parameters. The reflective cup 10 may be detachably attach to the tube body 30 with detachable attaching structure like hook structures or other fixing structures.

In the example, a top end of the reflective cup 10 has a convex structure, and the tube body 30 has a corresponding convex groove so that the detachable structure ensures the reflective cup 10 may be conveniently replaced another reflective cup 10 to the tube body 30.

In such embodiments, the reflective cup may be replaced directly from the tube body 30, instead of the need to detach the complete downlight apparatus to replace the reflective cup.

Furthermore, the surface of the terminal portion 33 may be attached to a heat sink. The heat sink is disposed with one or multiple holes for wiring electricity from the driver plate to the light source plate.

In some other embodiments, the tube body 30 may have a rim 31 close to of the openings of the reflective cup.

Two installation springs 40 may also be provided so as to attach the downlight apparatus to a ceiling.

In some embodiments, the tube body 30 may also include a protective cover 60 of the driver plate 50. With such protective cover 60, the driver plate 50 may be protected from moisture or bug problems.

Figure 9:
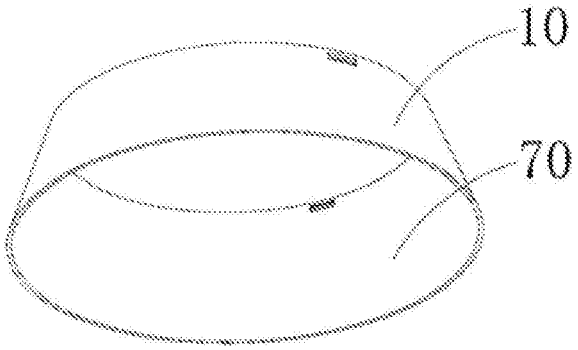
FIG. 9 illustrates a reflective cup with smooth reflective surface.
Figure 10:
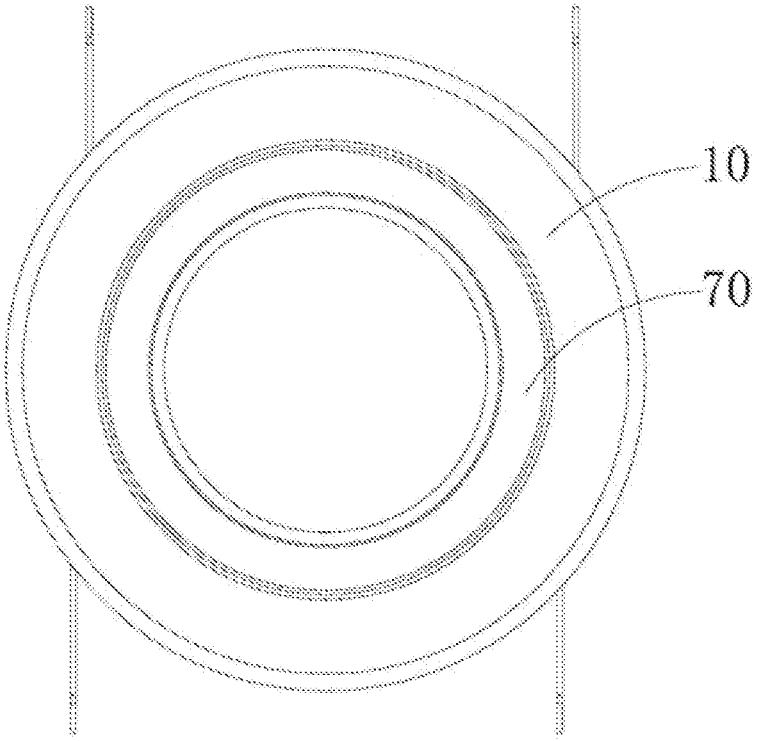
FIG. 10 is a top view of a downlight apparatus embodiment.

Please refer to FIG. 9 to FIG. 10. Different surface designs may be provided to different reflective cups for achieving different reflective effects.

For example, in FIG. 1, there are micro convex structures 80 on the reflective surface 70 of the reflective cup 10.

Figure 3:
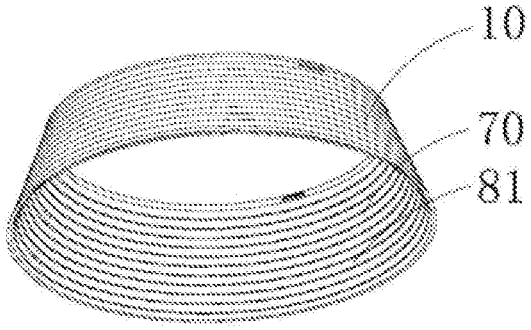
FIG. 3 illustrates a reflective cup example with convex bars.
Figure 4:
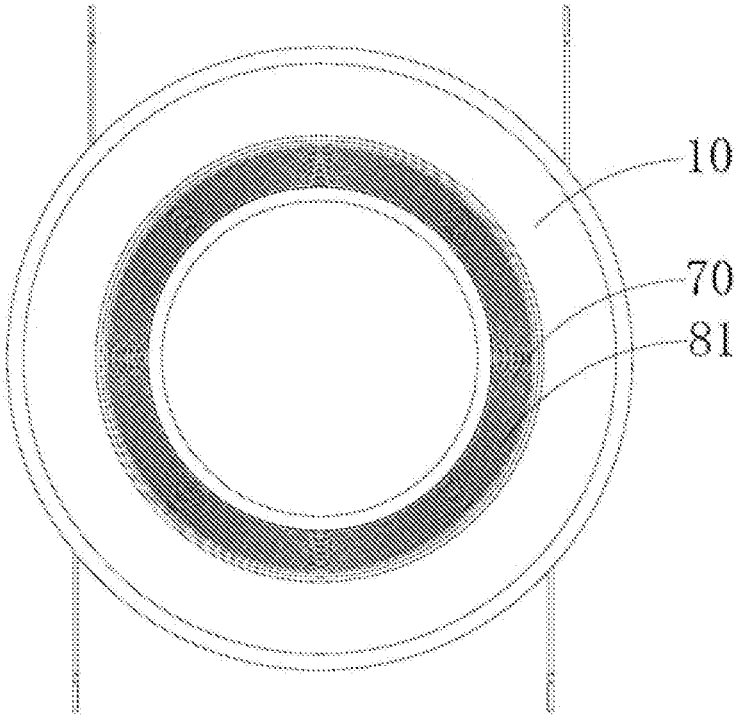
FIG. 4 is a top view of a downlight embodiment.

In FIG. 3 and FIG. 4, the reflective cup may have multiple micro convex structures 80 that are convex bars 81. The convex bars 81 formed as ring shapes may be arranged in parallel.

Figure 5:
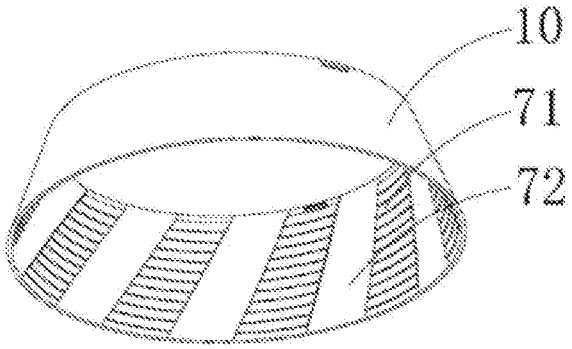
FIG. 5 illustrates a double reflective surface example.
Figure 6:
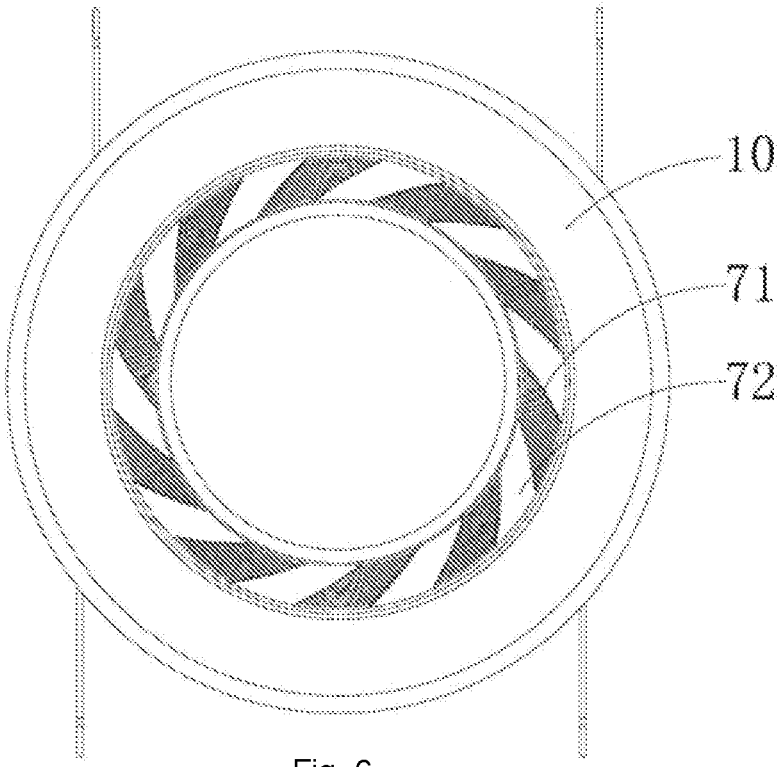
FIG. 6 is a top view of a downlight apparatus embodiment.

In FIG. 5 and FIG. 6, the reflective surface 70 has a first reflective surface 71 and a second reflective surface 72. The first reflective surface 71 and the second reflective surface 72 may have different reflective parameters.

In some other embodiments, the reflective parameters may be different in different portions of the reflective cup. For example, the inner portion near the light source plate may be designed to reflect more light away from the light source plate. the outer portion away from the light source plate may be roughened for diffusing light for avoiding glaring effect.

Figure 7:
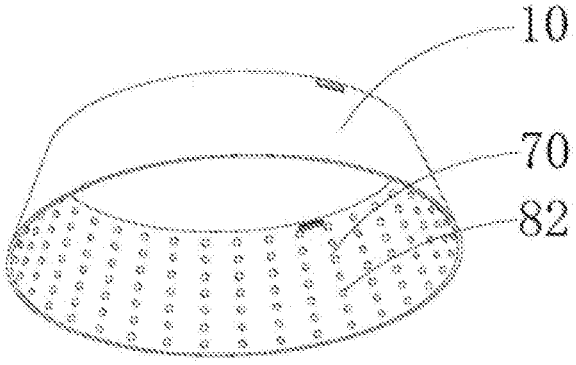
FIG. 7 is a reflective cup embodiment.
Figure 8:
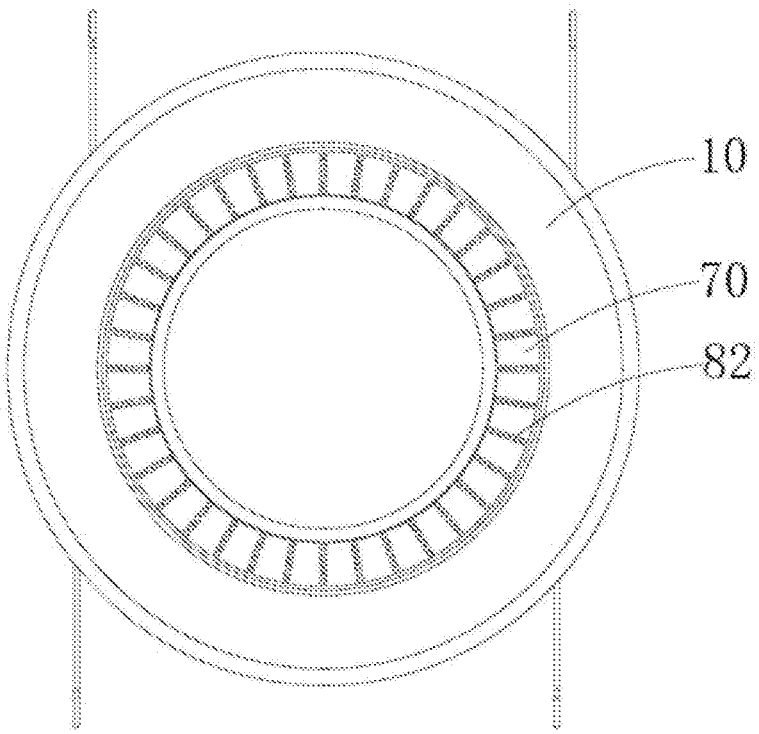
FIG. 8 illustrates a downlight with the reflective cup of FIG. 7.

In FIG. 7 and FIG. 8, there are convex dots 82 arranged on the reflective surface 70 of the reflective cup 10.

According to an embodiment, a downlight apparatus includes a tube body, a driver plate, a light source plate and a detachable attaching structure.

The tube body has an opening and a terminal portion opposite to the opening. For example, the tube body has a cup shape with a bottom side as the terminal portion. The light source plate is disposed on an interior surface of the bottom side of the tube body. The driver plate is attached to an exterior surface of the bottom side of the tube body.

The driver plate is disposed on an exterior surface of the terminal portion of the tube body. The light source plate is disposed on an interior surface of the terminal portion of the tube body. The exterior surface and the interior surface are opposite to each other, the light source plate is heat conductive to the terminal portion. For example, the light source plate engages the terminal portion directly.

The driver plate is electrically connected to the light source plate via a hole of the terminal portion of the tube body. More than one holes may also be disposed for connecting the light source plate and the driver plate so that the driver plate supplies a driving current to the light source plate.

In addition, the driver plate may also have wireless communication circuit. An antenna of the wireless communication circuit is disposed at the side of the light source plate, instead of being disposed on the driver plate so as to improve wireless signal quality.

The detachable attaching structure is disposed in the opening of the tube body.

The set of replaceable reflective cups are detachably attached to the detachable attaching structure, depending on different needs. Each reflective cup may have a different have different reflective characteristic for guiding light of the light source plate to render a different luminous effect.

With such design, users or workers for installing the downlight apparatus may replace a proper reflective cup by using the detachable attaching structure.

In some embodiments, the detachable attaching structure may include a convex structure corresponding to a concave structure of the replaceable cup. Different replaceable cups have the same concave structure.

In some other embodiments, the detachable attaching structure may include a concave structure corresponding to a convex structure of the replaceable cup. Different replaceable cups have the same convex structure.

In some other embodiments, the detachable attaching structure has a first magnet component corresponding to a second magnet component of the reflective cup. One of the first magnet component and the second magnet component may include magnet units while the other component may be also a magnet unit or a metal unit.

By using such design, it would be easier for users to replace a desired reflective cup. Additional fixing structure may also be used to enhance stability of the downlight apparatus.

In some embodiments, the detachable attaching structure has a first hook structure corresponding to a second hook structure of the reflective cup. Such hook structure may include a male part and a female part. The male part and the female part may be designed as a set. The male part is disposed in one of the first hook structure and the second hook structure and the female part is disposed in the other of the first hook structure and the second hook structure.

In some other embodiments, the detachable attaching structure is a screw structure for the reflective cup to be screwed into the screw structure to attach the reflective cup to the detachable attaching structure. For example, a screw groove may be disposed on the tube body for attaching to the reflective cup.

In some embodiments, there may be a rim surrounding the opening of the tube body, a top side of the reflective cup is close to the light source plate, and a bottom side of the reflective cup is close to the rim. The rim, the reflective cup and the tube body are arranged along the same axial line.

In some embodiment, the terminal portion of the tube body is attached with a heat sink. A cover may be used for covering and protecting the driver plate.

In some embodiments, the reflective cup has a height within range of 5 mm to 80 mm. A ratio between a largest diameter to the height of the reflective cup is between 0.05 to 0.75.

In some embodiments, one of the reflective cups has an inner reflective surface disposed with micro convex structures.

In some embodiments, the micro convex structures may include multiple ring bars arranged in parallel with respect to a top opening a bottom opening of the reflective cup.

In some embodiments, the micro convex structures may include multiple convex bars extended from a top opening to a bottom opening of the reflective cup.

In some embodiments, the micro convex structures may include multiple parallel convex bars extended from a top opening to a bottom opening of the reflective cup with a tilt angle to each other.

In some embodiments, the micro convex structures may include net shape convex bars. Specifically, the convex structures are arranged crossed to each other forming a net pattern.

Please note that the convex structure may be replaced with concave structures, or made of assembled patterns.

In some embodiments, at least one reflective cup has a first reflective part and a second reflective part. The first reflective part and the second reflective part have different reflective parameters. For example, the first reflective part is close to the terminal portion of the tube body and the second part is close to the opening of the tube body.

In some embodiments, the first reflective part has micro convex structures, and the second reflective part has a smooth reflective surface.

In some embodiments, the reflective cups have different colors. Users may install reflective cups with different colors for changing the overall luminous effect.

In some embodiments, at least one reflective cup has mixed colors, i.e. multiple colors.

In some embodiments, the reflective cup may include a light guide for guiding a light forming a light guide visual effect. For example, the reflective cup is made of PMMA material for guiding light into the light guide and escaping the light at desired positions, e.g. forming a ring visual effect.

In some embodiments, the reflective cup is disposed with a lens on a light passing opening of the reflective cup. A diffusion layer may also be installed in some other reflective cups. In other words, the same downlight apparatus may be adjusted to a focus light device or a diffusion light device depending on needs.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings. The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A downlight apparatus, comprising:

a tube body, having an opening and a terminal portion opposite to the opening;

a driver plate disposed on an exterior surface of the terminal portion of the tube body;

a light source plate disposed on an interior surface of the terminal portion of the tube body, the exterior surface and the interior surface being opposite to each other, the light source plate being heat conductive to the terminal portion, the driver plate being electrically connected to the light source plate via a hole of the terminal portion of the tube body;

a detachable attaching structure disposed in the opening of the tube body; and a set of replaceable reflective cups for being selected and detachably attached to the detachable attaching structure, the set of replaceable reflective cups have different reflective characteristics for guiding light of the light source plate to render different luminous effects, wherein at least one reflective cup has a first reflective part and a second reflective part, the first reflective part have multiple first segments and the second reflective part have multiple second segments, each first segment is extended from a top opening of the reflective cup to a bottom opening of the reflective cup along a main light direction from the light source plate, each second segment is extended from the top opening of the reflective cup to the bottom opening of the reflective cup along a main light direction from the light source plate, the multiple first segments and the multiple second segments are arranged alternatively, the first reflective part and the second reflective part have different reflective parameters, wherein at least one reflective cup has mixed colors.

2. The downlight apparatus of claim 1, wherein the detachable attaching structure comprises a convex structure corresponding to a concave structure of the replaceable cup, different replaceable cups have the same concave structure.

3. The downlight apparatus of claim 1, wherein the detachable attaching structure comprises a concave structure corresponding to a convex structure of the replaceable cup, different replaceable cups have the same convex structure.

4. The downlight apparatus of claim 1, wherein the detachable attaching structure has a first magnet component corresponding to a second magnet component of the reflective cup.

5. The downlight apparatus of claim 1, wherein the detachable attaching structure has a first hook structure corresponding to a second hook structure of the reflective cup.

6. The downlight apparatus of claim 1, wherein the detachable attaching structure is screw structure for the reflective cup to be screwed into the screw structure to attach the reflective cup to the detachable attaching structure.

7. The downlight apparatus of claim 1, wherein the terminal portion of the tube body is attached with a heat sink.

8. The downlight apparatus of claim 1, wherein the reflective cup has a height within range of 5 mm to 80 mm, a ratio between a largest diameter to the height of the reflective cup is between 0.05 to 0.75.

9. The downlight apparatus of claim 1, wherein one of the reflective cups has an inner reflective surface disposed with micro convex structures.

10. The downlight apparatus of claim 9, wherein the micro convex structures comprise multiple ring bars arranged in parallel with respect to a top opening and a bottom opening of the reflective cup.

11. The downlight apparatus of claim 1, wherein the first reflective part has micro convex structures, and the second reflective part has a smooth reflective surface.

* * * * *